US008156992B2

(12) United States Patent
Diaz et al.

(10) Patent No.: US 8,156,992 B2
(45) Date of Patent: Apr. 17, 2012

(54) GARAGE DOOR APPARATUS

(76) Inventors: Carlos L. Diaz, Fillmore, CA (US); Luis Manuel Casas Barrios, Ventura, CA (US); Gerardo Casas Barrios, Ventura, CA (US)

( * ) Notice: Subject to any disclaimer, the term of this patent is extended or adjusted under 35 U.S.C. 154(b) by 180 days.

(21) Appl. No.: 11/872,146

(22) Filed: Oct. 15, 2007

(65) Prior Publication Data

US 2008/0029228 A1 Feb. 7, 2008

Related U.S. Application Data

(63) Continuation-in-part of application No. 10/891,901, filed on Jul. 13, 2004, now abandoned.

(51) Int. Cl.
*E05D 15/06* (2006.01)

(52) U.S. Cl. ..... 160/201; 160/196.1

(58) Field of Classification Search ..... 160/222, 160/197, 214, 118, 196.1, 188, 201; 49/472; 104/1, 146, 140; 198/860.3, 860.5
See application file for complete search history.

(56) References Cited

U.S. PATENT DOCUMENTS

| | | | | | |
|---|---|---|---|---|---|
| 1,259,042 | A | * | 3/1918 | Phillips | 160/196.1 |
| 1,514,140 | A | | 11/1924 | Dodge | |
| 2,959,220 | A | * | 11/1960 | Latham | 160/199 |
| 3,003,551 | A | * | 10/1961 | Ferris | 160/196.1 |
| 3,071,825 | A | * | 1/1963 | Ferris | 49/127 |
| 3,416,183 | A | * | 12/1968 | Martin | 16/105 |
| 4,347,791 | A | * | 9/1982 | Mandros | 104/156 |
| 4,447,986 | A | | 5/1984 | Wilkins et al. | |
| 5,267,597 | A | | 12/1993 | Green | |
| 5,426,892 | A | | 6/1995 | Haab et al. | |
| 6,098,695 | A | | 8/2000 | Schwingle | |
| 6,719,033 | B2 | | 4/2004 | Stoltenberg | |
| 2003/0141023 | A1 | | 7/2003 | Griebel | |

* cited by examiner

*Primary Examiner* — Blair M. Johnson
(74) *Attorney, Agent, or Firm* — Kelly & Kelley, LLP

(57) ABSTRACT

A garage door is connected to a track extending from a front wall of the garage to a side wall within the garage. The garage door is horizontally moveable along the track, such as with a chain-driven mechanism, from a generally closed position within the garage vehicle entrance of the garage to a generally open position away from the garage vehicle entrance and disposed adjacent to a side wall of the garage. A second horizontally moving garage door may be used in conjunction with the first garage door to cooperatively close the garage vehicle entrance.

8 Claims, 11 Drawing Sheets

GARAGE DOOR APPARATUS

BACKGROUND OF THE INVENTION

This invention generally relates to garage doors. More particularly the present invention relates to a garage door particularly adapted for residential houses which opens and closes horizontally, instead of vertically.

Many residences have a garage, and thus a garage door. Garages are particularly designed for storing vehicles in an environment which is not exposed to weather and dust. Garages have also evolved into a place for storing items, such as bicycles, exercise equipment, boxes of memorabilia or infrequently used items, etc.

Garages are sized so as to accommodate as few as one vehicle to many vehicles. Garages include retractable doors, such that the garage can be opened for the vehicle can enter and subsequently closed. In the past, such doors were manually opened and closed. Thus, the garage door was often a single wooden door which was pivoted upwardly and downwardly to open and close the garage to expose the vehicle entrance. However, it is more common currently that the garage door be opened and closed automatically, such as by using motors connected to drive trains or rods which can be selectively moved or rotated in opposite directions to open and close the garage doors. Typically, the garage door will run on tracks which extend from opposite sides of the garage vehicle entrance towards the ceiling of the garage. The garage door opener is positioned within the garage towards the ceiling so as to pull the garage door upwardly towards the ceiling on its track as it is opened, and subsequently move the garage door downwardly and into the vehicle entrance to close the garage. Such garage doors are typically comprised of a plurality of horizontally pivotally connected panels to facilitate this vertical movement.

However, several problems are presented with the current design of garage doors. Even with a two-door garage door, the entire garage door must be completely opened in order to allow even a single vehicle to enter or exit the garage. Completely opening the garage exposes the entire garage to view from the street and neighboring houses. This can be undesirable if the garage is untidy or contains items of interest that might be possibly stolen. As such, some homeowners will actually partially open the garage door and stop it in its opening progress so that sufficient room between the driveway and the bottom edge of the garage door is provided so that the homeowner can bend over and enter or exit the garage. Aside from this inconvenience, there is a safety concern that the garage door could be inadvertently closed while entering or exiting the garage, possibly injuring the individual.

Another disadvantage of currently designed garage doors is that the motor and track are disposed above the garage door towards the ceiling, often wasting a tremendous amount of space as they are hung from the ceiling immediately above the garage door. These components are also unsightly when the garage door is open.

As the garage doors are currently lifted vertically, they must be comprised of a relatively light-weight material so as to be suspended from the track and the ceiling. Such material can often be bent or otherwise broken to access the garage. Also, it is a common problem that garage doors are lifted upwardly to gain access to the garage by would-be thieves and the like.

Doors which close horizontally, as opposed to vertically, are known in the prior art. For example, U.S. Pat. No. 1,514,140 to Dodge discloses a door construction in the form of accordion-style folding partitions which fold in order to open the door, and are unfolded and extended outwardly across the doorway to close the door. Also, U.S. Pat. No. 5,267,597 to Green discloses a garage door apparatus having upper and lower tracks and a plurality of panels vertically oriented and pivotally interconnected with one another such that the panels are moved along the tracks to open and close the door in a horizontal, as opposed to a vertical, movement.

However, it has been discovered by the inventor that garage floors are typically not flat. For example, it has been found that there is a several inch rise in elevation between the garage door opening and the door leading into the residence. This may be due to building code requirements, wherein water would be shunted and directed away from the residence, such as if the water heater were to leak. While this does not present a problem to the accordion folding partition-style door of Dodge, it does present drawbacks to the Green arrangement. This is due to the fact that the partition doors, as they are opened, travel up the slope of the garage floor. This can cause binding, or prevent the smooth movement of the panels, as the panels are moved to a fully opened position within the garage.

It has also been discovered that positioning the wheels or rollers, which are engaged with the upper and lower tracks, intermediate the edges of the panels, such as approximately in the middle of the panels, also create binding and prevents smooth movement of the panels as the panels are moved between open and closed positions, and particularly at the bends of the upper and lower tracks as they transition between the garage door opening and the interior of the garage.

Furthermore, the presence of a lower track within the garage, and particularly adjacent to the opening of the garage, may present a hazard to those traversing the lower track, such as women wearing high heels and the like. Also, debris, such as leaves, rocks and the like, can become lodged within the lower track, preventing smooth operation of the garage door.

Accordingly, there is a continuing need for a garage door apparatus which is not vertically opened and closed, but rather horizontally opened and closed to overcome the aforementioned disadvantages. Also, improvements are needed for such a horizontally opening garage door to overcome the deficiencies noted above. The present invention fulfills these needs and provides other related advantages.

SUMMARY OF THE INVENTION

The present invention resides in a garage door for a residential house which opens horizontally instead of vertically. A track extends from a front wall to a side wall within the garage. Typically, an upper track extends from a front wall of the garage defining a garage vehicle entrance into the garage and adjacent to a side wall within the garage. A lower track is attached to or formed in the floor of the garage and extends generally parallel to the upper track from the front wall to the side wall within the garage. A garage door is connected to the tracks so as to be movable along a length of the tracks. Typically, the garage door is comprised of a plurality of vertically pivotally interconnected panels to accommodate such horizontal movement.

The garage door includes a plurality of upper wheel assemblies extending from upper edges of the garage door panels and operably engaged with the upper track. Similarly, a plurality of lower wheel assemblies extend from lower edges of the garage door panels and are operably engaged with the lower track.

Means are provided for moving the garage door along the track from a generally closed position in a garage vehicle entrance defined by the front wall of the garage, to a generally open position away from the garage vehicle entrance so as to be disposed adjacent to the side wall of the garage. Such moving means typically comprises a chain or screw operatively connected to the garage door and a motor for selectively moving the chain or screw.

In a particularly preferred embodiment, a plurality of the upper or lower wheel assemblies are configured to bias a wheel thereof away from the garage door panel so as to permit limited vertical movement between the wheel and the garage door panel so as to accommodate the slope of the garage floor. Moreover, the upper and lower wheel assemblies include outer wheel assemblies disposed adjacent to a leading edge and a trailing edge of the garage door. Inner wheel assemblies are disposed above or below a gap between side edges of the vertical panels of the garage door so as to be positioned in alignment with the gap to prevent binding as the garage door panels are moved along the length of the upper and lower tracks. In a particularly preferred embodiment, the inner wheel assemblies include a support pivotally attached to a first vertical panel and extending over a portion of a second adjacent vertical panel to provide for such arrangement.

In a particularly preferred embodiment, such as when the garage accommodates multiple vehicles, a second garage door is connected to a second set of tracks extending from the front wall of the garage to an opposite side wall within the garage. Additional means, such as the chain-driven motor, are provided for moving the second garage door along the second set of tracks between its closed and open positions.

Either garage door may include a walk-in door formed therein which is adapted to permit access to the garage when the garage doors are in their closed positions. The walk-in door can be a standard door having a latch or handle and locking means.

Sensors may be included in the garage door for detecting objects within the garage vehicle entrance for stopping movement of the garage door in the event a child or other individual is in the path of the moving garage door. For security purposes, a catch may be formed in the front wall of the wall adjacent to the garage opening which is adapted to releasably receive an extension of a trailing edge of the garage door as it is closed.

In one embodiment, a garage door apparatus includes a cover assembly adapted to cover at least a portion of the lower track when the garage door is opened. The cover assembly generally comprises first and second cover members which are biased towards one another so as to cooperatively cover at least a portion of the lower track, such as at the garage door entrance.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
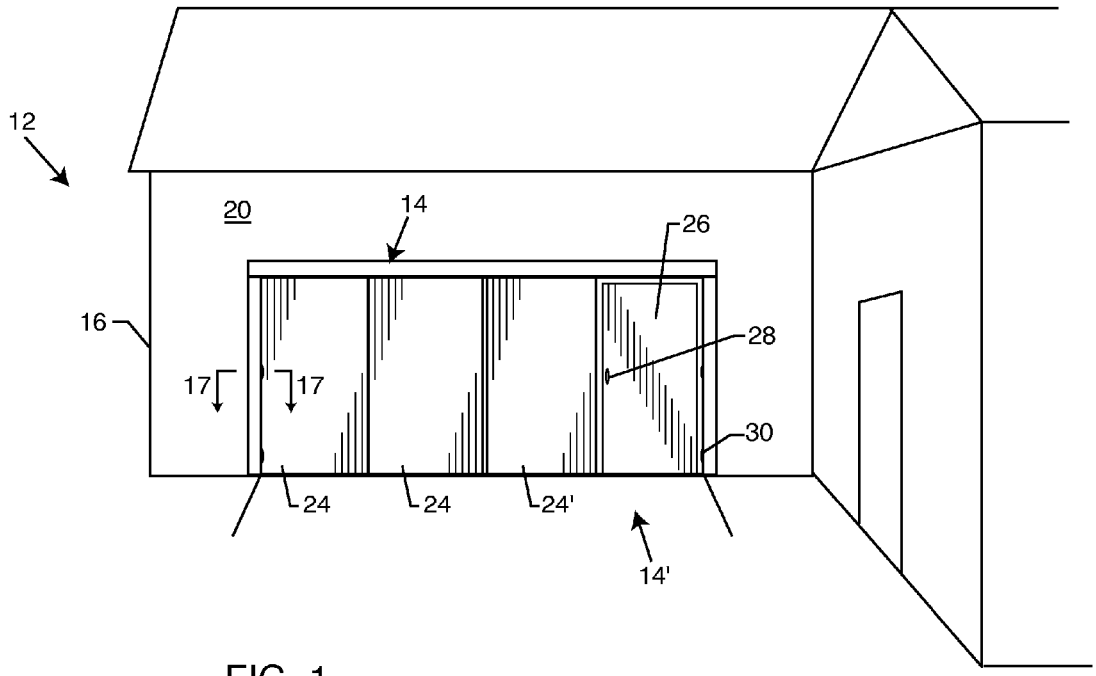
FIG. 1 is a partial perspective view of a residential house having a garage and garage door embodying the present invention.

As shown in the accompanying drawings for purposes of illustration, the present invention resides in a garage 12 having a unique garage door 14 which is designed so as to travel horizontally while opened and closed instead of vertically. The garage door 14 is particularly adapted for use in residential houses and the like.

With reference now to FIGS. 1-4, as is commonly known, a garage 12 of a residential house includes a ceiling, and a back wall (not shown) as well as opposing side walls 16 and 18 as well as a front wall 20 defining an opening 22 which is sized so as to permit vehicle entrance and exit from the garage 12. It is well known that such garage openings 22 can accommodate a single vehicle or many vehicles. In some instances, for example, a garage 12 may be sized so as to house and store three vehicles therein. The garage doors used may comprise three separate doors, each sized to accommodate a single vehicle, or may comprise a single door for a single vehicle as well as a double-door sized to accommodate two vehicles. Other sized garages and garage door combinations are possible.

The garage door 14 of the present invention is illustrated and described as a double-door, that is two separate doors which co-operatively close the garage vehicle entrance 22. However, it will be understood that the principles of the invention could be used for a single garage door 14, or multiple garage doors as necessary. A particularly unique aspect of the present invention is that the door 14 open and close with a horizontal movement, which overcomes many of the disadvantages of the vertically moved garage doors in the prior art, as will be described more fully herein.

With continuing reference to FIGS. 1-4, each garage door 14 and 14' is preferably comprised of a plurality of panels 24 and 24' which are pivotally connected to one another along a vertical side wall thereof. The use of such panels 24 facilitates the movement of the garage door 14 or 14' into and out of their respective opened and closed positions.

In a particularly preferred embodiment, a walk-in door 26 is formed in one of the panels 24 or 24'. As illustrated in FIG. 1, this allows access into and out of the garage 12 while the garage doors 14 and 14' are in their closed positions. The walk-in door 26 could be of a normal variety having a handle 28 or latch and a lock used to open and close the door 26. The door is preferably hinged, or is preferably pivotally connected to the garage door 14 or 14' with hinges 30 along a vertical side wall thereof, in traditional fashion. In this manner, the homeowner is able to enter and exit the garage 12, such as to retrieve the newspaper or mail or perform yard work, without the need to actually open the garage doors 14 or 14' and expose the contents of the garage 12 to those passing by. This also allows children to enter and exit the garage 12 without the danger of the garage doors 14 or 14' being opened or closed.

Figure 2:
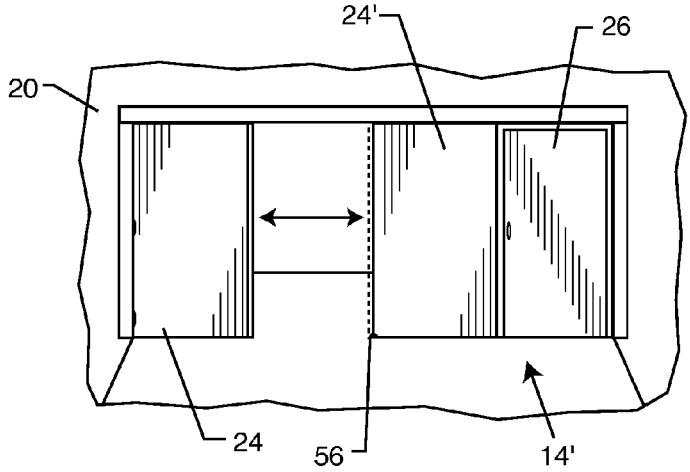
FIG. 2 is a partially fragmented elevational view of the garage door of FIG. 1, illustrating a first garage door thereof partially opened.
Figure 3:
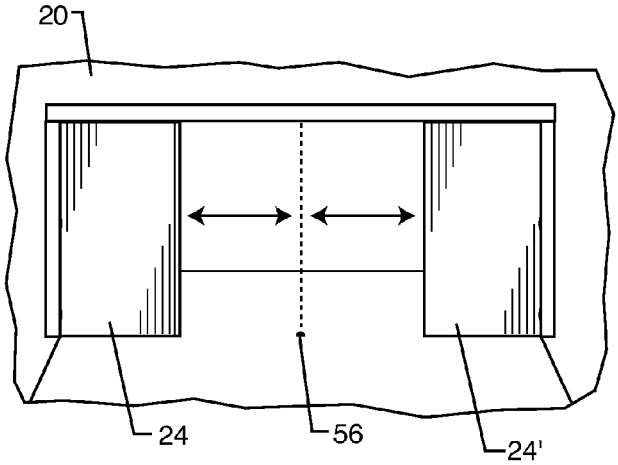
FIG. 3 is a partially fragmented elevational view similar to FIG. 2, illustrating a second garage door partially opened.

Alternatively, the garage door 14 may be opened only partially, as illustrated in FIG. 2. Although the walk-in door is illustrated in FIG. 2, it will be appreciated that such is not necessary as the partial opening creates the desired space potentially equivalent to a door for entrance and exit into and out of the garage 12. Such entrance and exit can be done in normal fashion, without having to stoop or bend over, as is the case when partially opening a vertically opened garage door. The entire garage door 14 or 14' can be opened, or each garage door 14 and 14' can be partially opened as illustrated in FIG. 3. The position illustrated in FIG. 3 would enable a car to be parked within a central portion of the garage 12, or the transport of larger items into or out of the garage, etc.

Figure 4:
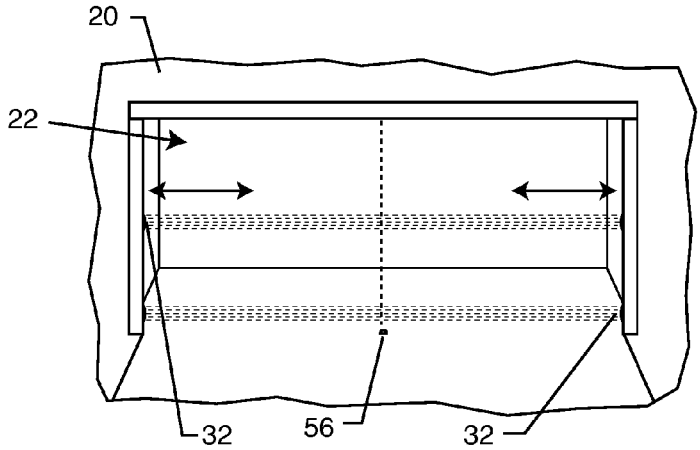
FIG. 4 is a fragmented elevational view illustrating the first and second garage doors completely opened and motion sensors for detecting movement within the garage opening.

With particular reference to FIG. 4, in a particularly preferred embodiment, sensors 32, such a motion sensors are disposed in relation to the garage vehicle entrance opening 22 so as to sense and monitor objects within the path of the garage door 14 and 14'. Such sensors 32 are linked to the drive mechanism which moves the garage doors 14 and 14' such that when an object crosses the path of travel of the garage door 14 or 14', the movement of the garage door 14 or 14' is automatically stopped as a safety precaution. Of course, it will be appreciated that the garage door 14 and 14' of the present invention would be moved into the body of the child or individual in its path instead of directly onto his or her head as with a traditional vertically closing garage door. Thus, even if the sensors were to malfunction, the likelihood of injury is dramatically reduced.

Figure 5:
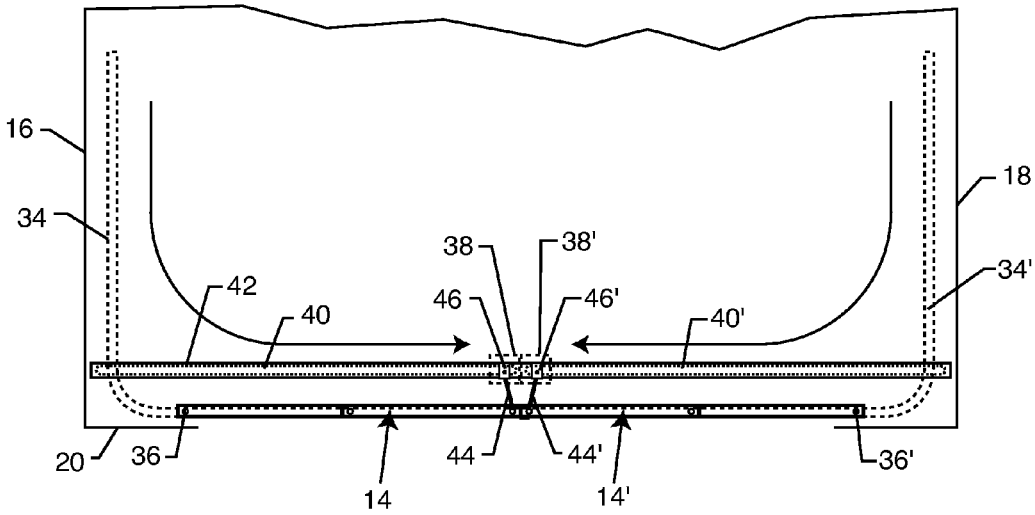
FIG. 5 is a partially fragmented top plan view of the garage illustrating the garage doors moved along a track from side walls of the garage to a closed position in the garage opening.
Figure 6:
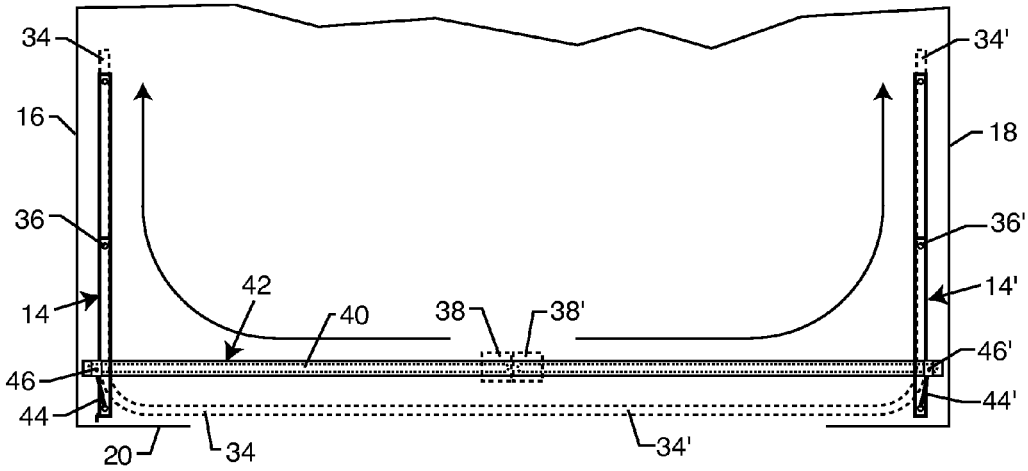
FIG. 6 is a view similar to FIG. 5, illustrating the garage doors moved from the garage opening towards the side walls of the garage and into their open position.
Figure 7:
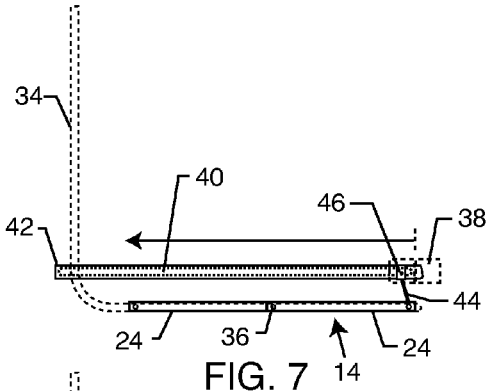
FIGS. 7-14 are diagrammatic views illustrating step-wise movement of the garage door between its closed and open positions.
Figure 8:
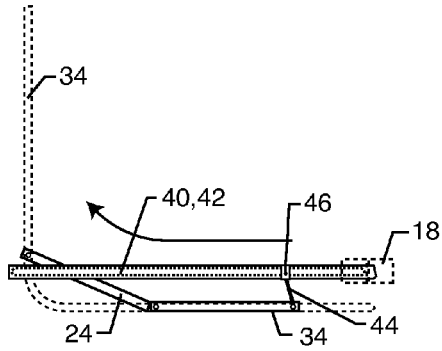
Figure 9:
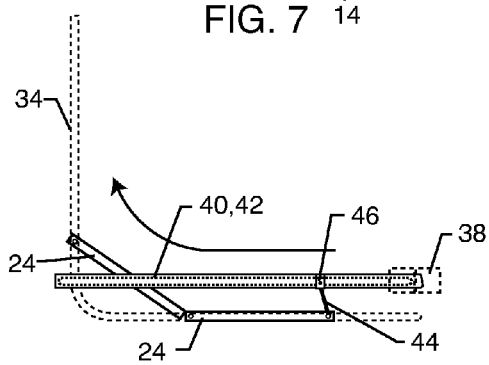
Figure 10:
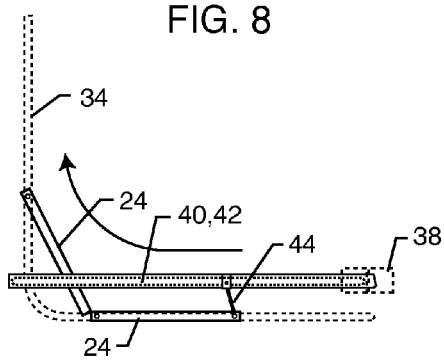
Figure 11:
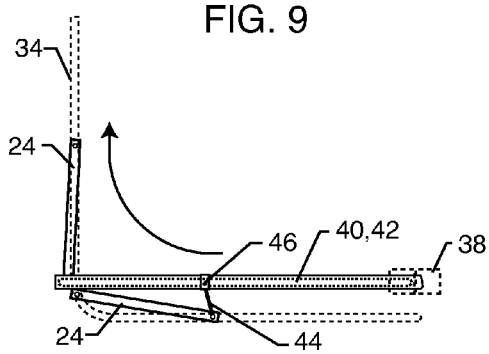
Figure 12:
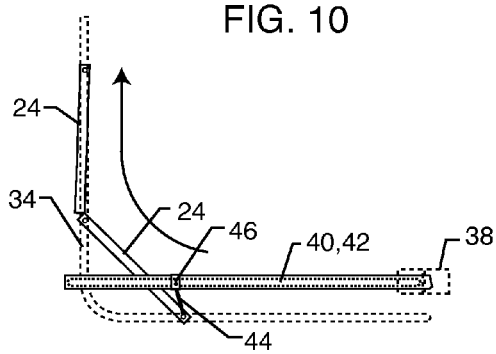
Figure 13:
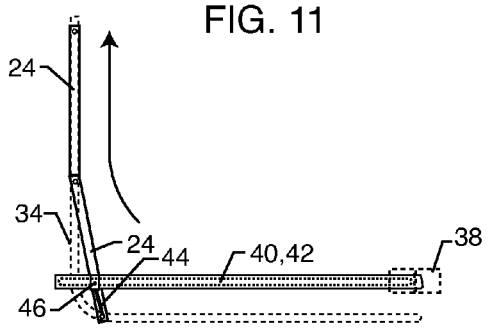
Figure 14:
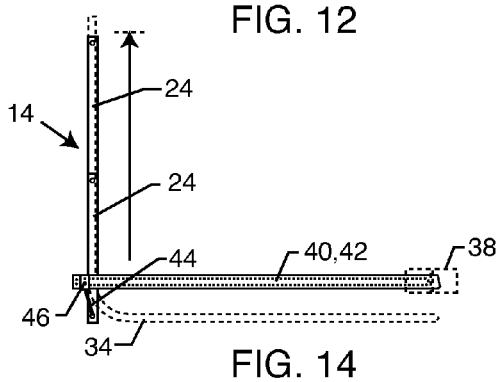

With reference now to FIGS. 5 and 6, each garage door 14 and 14' is movably connected to a track 34 and 34' which extends from the front wall 20 of the garage, above the vehicle entrance opening 22 towards and along the side wall 16 or 18. For example, the garage doors 14 and 14' may include rollers 36 which are rotatably mounted within the track 34 and 34'. As illustrated in FIG. 6, the track 34 may be continuous and still accommodate both garage doors 14 and 14', or alternatively, the tracks 34 and 34' may be separately used to mount each garage door 14 and 14'. A drive mechanism or any other means, may be used to selectively move the garage doors 14 and 14' from their generally closed positions, illustrated in FIG. 5, to their generally open position, as illustrated in FIG. 6. Typically, such a drive means comprise a garage door opening motor 38 which is used to move a chain 40, or sometimes a worm screw or the like, in reciprocal fashion. In the illustrated embodiment, a chain 40 is used. The chain 40 runs along a track 42 which guides the chain 40 as it moves. The motor 38 is of a reversible type such that when actuated in one direction or polarity, the chain is moved in a first direction, and upon being switched to the opposite polarity, the chain is moved in the opposite direction.

The garage doors 14 and 14' are operably connected to the chain 40 or other driving mechanism. In the illustrated embodiment, a swing arm 44 extends from the garage door 14 and 14' to a bracket 46 which is operably connected to the chain 40 and moved along the chain track 42.

With reference now to FIGS. 7-14, sequential movement of the garage door 14 from a generally closed position to a generally opened position is illustrated. The motor 38 would be actuated such so as to move the chain in a generally clockwise motion so as to gradually move the garage door panel 24 of the garage door 14 along their track 34 as the bracket 46 is moved with the chain 40. It will be noted that the panels 24 of the garage door 14 pivot along a vertical axis at hinges between the panels 24 during this process to facilitate the movement of the door 14 from the garage opening 22 towards the side wall 16 of the garage.

Figure 15:
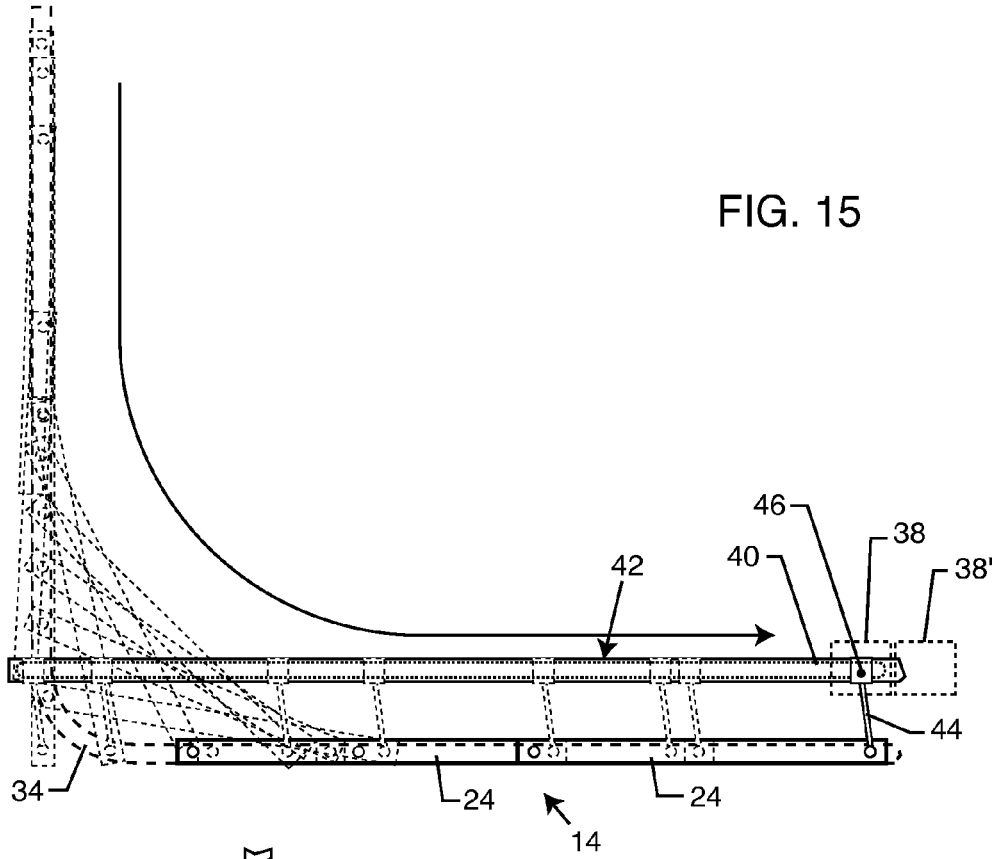
FIG. 15 is a diagrammatic view illustrating sequential positions of the garage door being moved from a generally open position to a closed position in accordance with the present invention.

FIG. 15 illustrates the progressive motion of the garage door 14 from its generally open position adjacent to the side wall 16 towards and into the garage vehicle entrance opening 22 so as to be placed in a closed position. Essentially, the reverse steps are taken of the steps above, by reversing the direction of the chain 40, or other driving means. Although it is conceivable that a single driving mechanism can be used to operate both garage doors 14 and 14' simultaneously, typically separate garage door openers 38 and 38' are operatively connected to the separate garage doors 14 and 14' for individually moving each.

Figure 16:
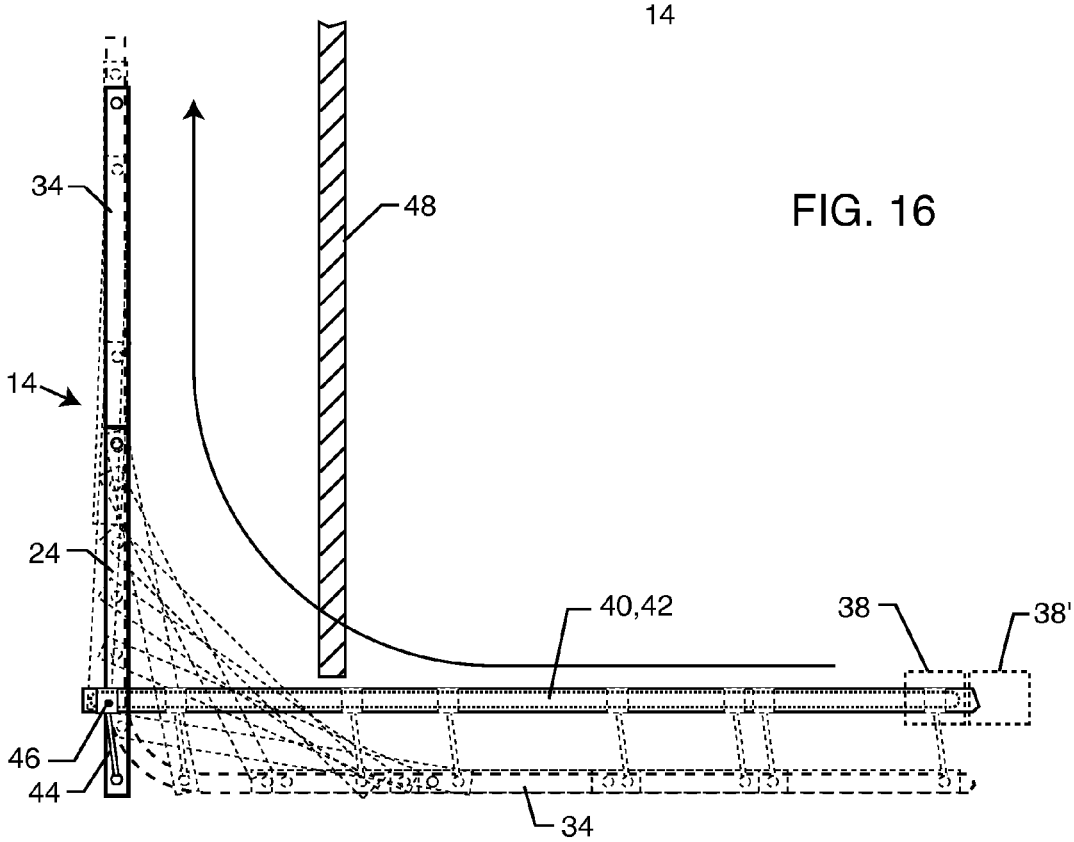
FIG. 16 is a diagrammatic view of the garage door being moved from a generally closed position within the vehicle entrance of the garage to a generally open position adjacent to a side wall of the garage, and obscured by a wall within the garage.

FIG. 16 illustrates the step-wise movement of the garage door 14 from its closed position to its open position towards the side wall 16. FIG. 16 also illustrates a false wall 48 or other type a fascia which is used on an opposite side of the side wall 16 so as to serve to hide the track 34 and other garage door components from view within the garage, aesthetically improving the garage interior, although such is not necessary.

Figure 17:
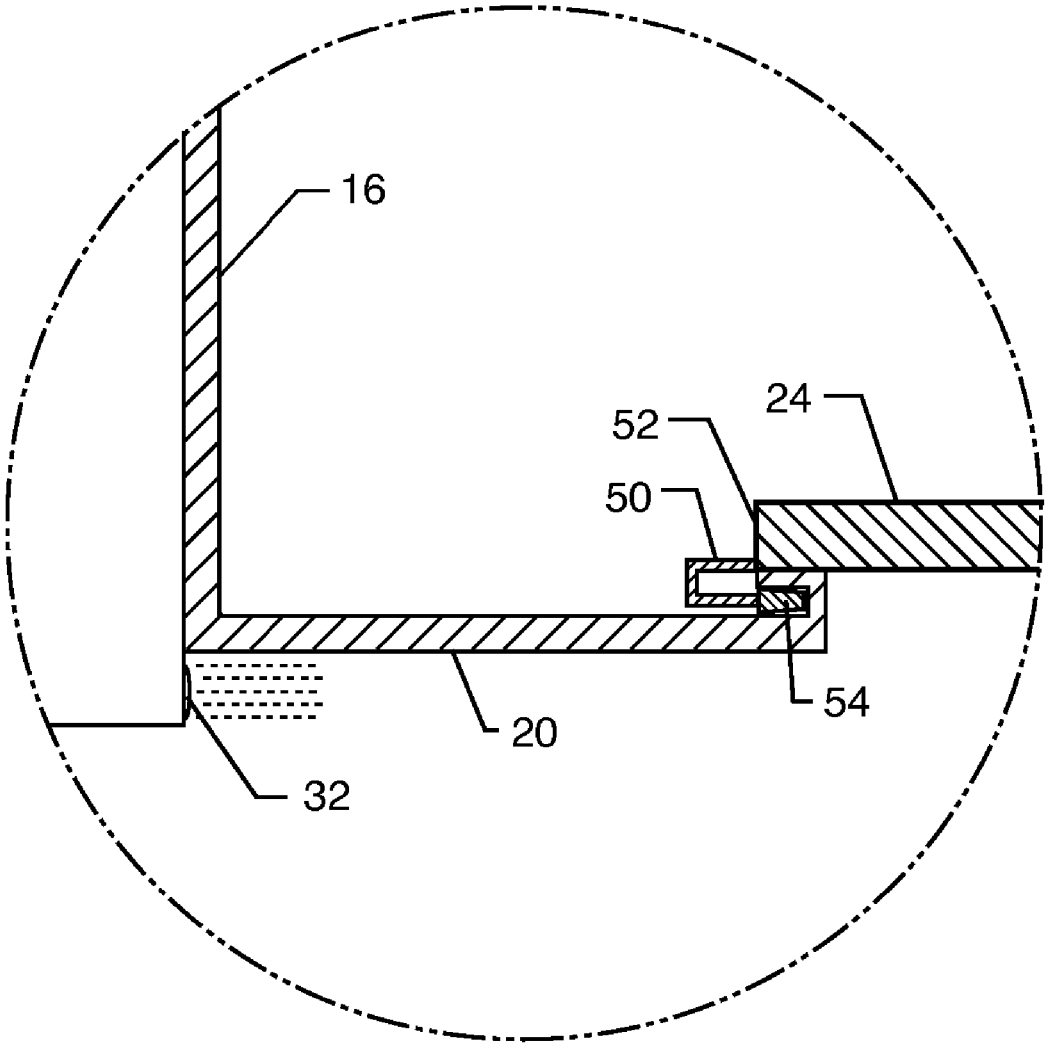
FIG. 17 is an enlarged cross-sectional view taken along line 17-17 of FIG. 1, illustrating an extension of trailing edge of the garage door received within a catch formed in a front wall of the garage adjacent to the opening.

With reference now to FIG. 17, a common security problem with traditional vertical opening and closing garage doors is that they can somewhat easily be pried open by grasping the bottom portion of the door and pivoting and sliding the door upwardly, allowing access to the garage by would-be-thieves and the like. The present invention is designed to overcome such security concerns. As illustrated in FIG. 17, an extension 50 extends from a trailing edge 52 of the garage door 14. Extension 50 is configured such as to be removably received within a catch 54 attached to or formed in a front wall 20 the garage opening 22. Thus, as the garage door 14 is closed, the extension 50 is received within the catch 54, thus would-be-thieves trying to push the outer edges of the garage door 14 or 14' are unable to move them inward to gain access to the garage 12.

With reference again to FIGS. 2-4, in a particularly preferred embodiment, a stop 56 is fastened to the driveway at the garage opening 22 where the garage doors 14 and 14' meet. The stop 56 can serve to prevent would-be thieves from pushing the garage door 14 and 14' inward at their junction. The stop 56 can also serve to limit the motion of the respective garage door 14 or 14' and thus act as an alignment so as to be disposed within the first and second garage doors 14 and 14' when closed. If a single garage door 14 is used, the stop 56 may be positioned on an opposite end of the front wall 20 from the catch 54 to prevent the inward opening of the garage door by would-be thieves. A particular advantage of the horizontally opening and closing garage door 14 of the present invention is that the door panels 24 can be comprised of a much more sturdy and heavy material as they do not need to be lifted vertically onto an overhanging track system, as in traditional residential garages. Thus, would-be-thieves will find it more difficult to force their entry into the garage 12.

Figure 18:
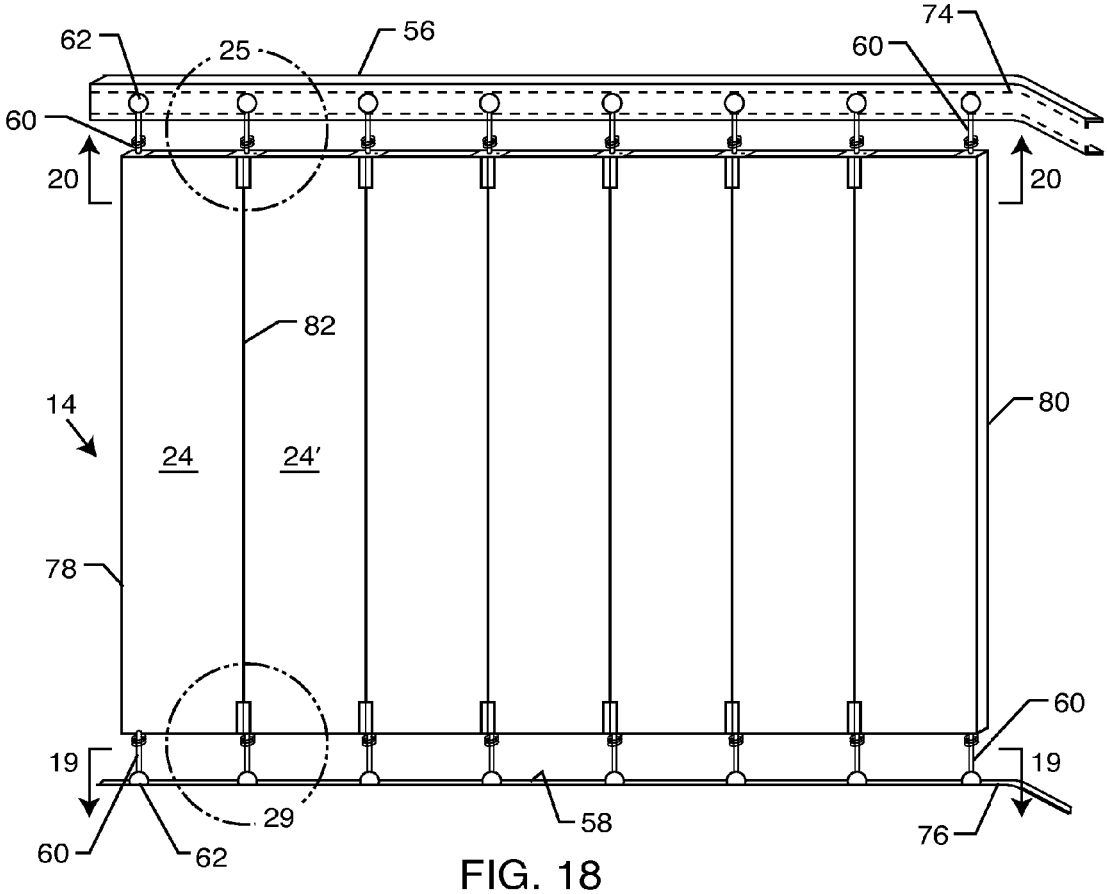
FIG. 18 is a side elevational view of a garage door apparatus embodying the present invention.
Figure 19:
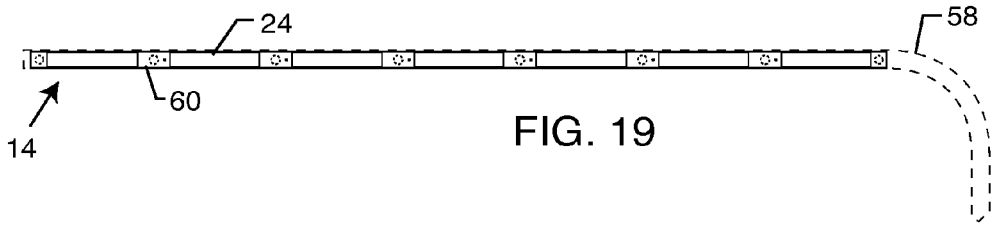
FIG. 19 is a view of the garage door apparatus, taken generally along line 19-19 of FIG. 18.
Figure 20:
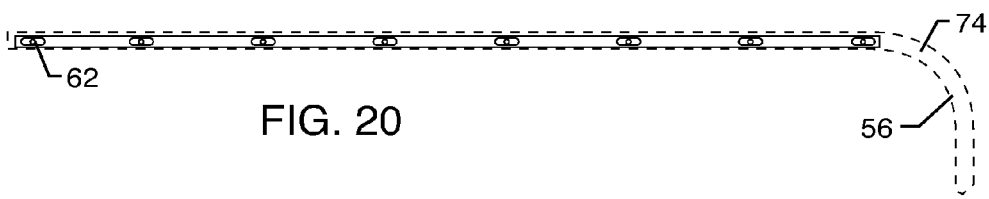
FIG. 20 is a view taken generally along line 20-20 of FIG. 18.

With the embodiments illustrated and described above, the garage door 14 is moved along a single upper track 34. However, as illustrated in FIG. 18, in a particularly preferred embodiment, the garage door 14 is interconnected between an upper 56 and a lower 58 track. Such an arrangement has been found to provide added stability and improved control and motion and movement of the garage door 14 as it is opened and closed. Upper track 56 is substantially similar to the track 34 illustrated and described above. Lower track 58 is either attached to the floor of the garage, so as to run substantially parallel to the upper track from the front wall of the garage to a side wall within the garage, or is formed in the floor, typically cement, of the garage as the garage is built. However, in most cases, the lower track 58 is attached to the floor of the garage after it has been built.

As discussed above, it has been found that garage floors are not an even, flat surface. More particularly, it has been found that the garage floor is somewhat inclined or sloped from the garage door entrance towards the residence. Depending upon the size of the garage, the slope can be several inches in height. It will be appreciated by those skilled in the art that accommodations must be made to the horizontally opening and closing garage door apparatus so that the garage door can be fully opened and closed in a smooth manner without binding. This problem has not been addressed in the prior art. However, in the present invention, as will be more fully described below, wheel assemblies are provided which are configured to permit limited vertical movement between the wheel assembly and a garage door panel such that as the garage door is opened and moves up the incline of the garage floor, the garage door panel 24 moves vertically while the wheel or roller continues to engage the track.

More particularly, with reference to FIG. 18, in a particularly preferred embodiment, the garage door 14 includes wheel assemblies 60 which are configured to bias a wheel 62 thereof away from the garage door panel 24. The biasing means permits limited vertical travel between the wheel 62 and the garage door panel 24. As illustrated in FIG. 18, there are a plurality of upper wheel assemblies 60 attached to an upper edge or surface of the plurality of garage door panels 24, as well as a plurality of lower wheel assemblies 60, extending downwardly from a lower surface or edge of the garage door panels 24. In this manner, the garage door panels 24 are operably engaged with both the upper track 56 and the lower track 58. As illustrated, both the upper and lower wheel assemblies 60 include springs or biasing members. However, it will be understood that only the lower wheel assemblies 60 or the upper wheel assemblies 60 may incorporate such strings or other biasing members as it is only necessary that an upper set or lower set of wheel assemblies 60 permit the vertical movement of the door panels 24. However, both upper and lower wheel assemblies 60 may incorporate such strings or other biasing means so as to cooperatively permit vertical travel of the garage door panel 24, while continuing to engage the upper track 56 or lower track 58.

Figure 25:
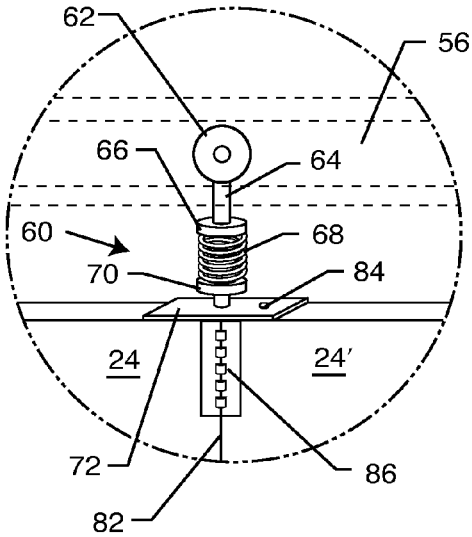
FIG. 25 is an enlarged perspective view taken generally along area "25" of FIG. 18, illustrating a top wheel assembly extending between an upper track and garage door panels, in accordance with the present invention.
Figure 26:
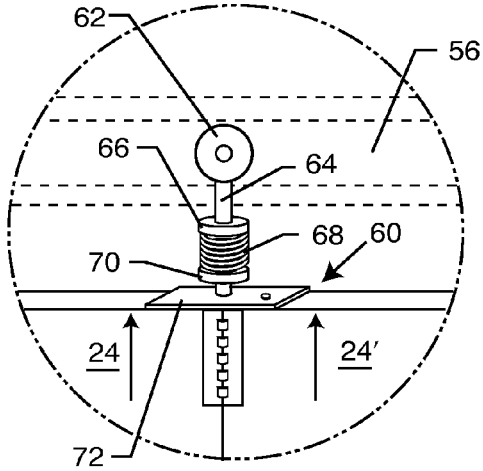
FIG. 26 is an enlarged perspective view similar to FIG. 25, but illustrating the garage door panels moved vertically upwardly, and the compression of the wheel assembly, in accordance with the present invention.

With reference now to FIGS. 25 and 26, an enlarged view of a wheel assembly 60 is shown. It will be noted that the wheel or roller 62 is operably engaged with the upper track 56. The wheel assembly 60 is operably attached to adjoining garage door panels 24 and 24', as will be discussed more fully below. Wheel assembly 60 also includes a wheel, roller, or any other member which operably engages with the track 56 and enables the sliding or rolling movement of the garage door 14. A shaft 64 extends downwardly from the wheel or roller 62 to a plate 66 which is biased upwardly by spring 68. Spring 68, which is a compression spring, is fitted between upper plate 66 and lower plate 70, so as to push the upper plate 66, and thus the wheel 62, upwardly and in engagement with the track 56. The lower plate 70 is operably connected to a lower support 72 of the wheel assembly 60, which is directly attached to the garage door 14, and more particularly one of the garage door panels 24 or 24', as will be discussed more fully below. Thus, the compression spring 68 serves to exert opposing forces upon the wheel 62 and the underlying garage door panels 24 and 24'.

When the garage door 14 is disposed adjacent to the opening of the garage 22, or the lowest point of the garage floor, spring 68 may be in a natural and non-compressed state so as to exert little, if any, force upon the wheel 62 and the support member 72, and thus the garage door 14. However, as illustrated in FIG. 26, when the garage door 14 is moved into an open position within the garage, increasingly the space between the upper and lower tracks 56 and 58 narrows, due to the incline of the garage floor. Thus, as the garage door 14 is moved increasingly inwardly into the garage, the spring 68 compresses due to the upward movement of the garage door panels 24 and 24', which force is translated through support member 72, lower plate 70 so as to compress spring 68. It will be appreciated that the roller or wheel 62 may have very little, if any, vertical movement as it needs to operably slide or rotate within track 56. Thus, the compression of spring 68 provides the upper vertical movement of panels 24 and 24' without forcing wheel 62 upward and into a binding situation within track 56.

Figure 29:
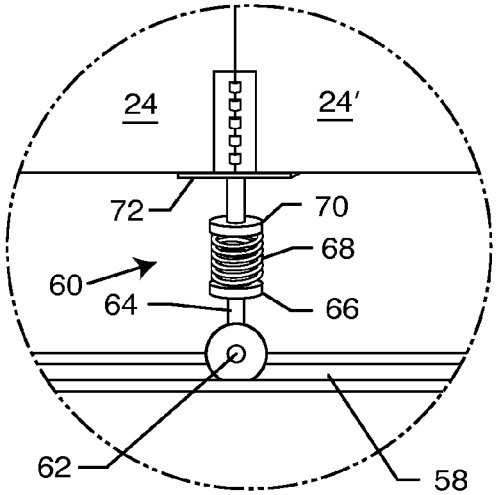
FIG. 29 is an enlarged perspective view taken generally along area "29", illustrating a lower wheel assembly engaged with a lower track of the apparatus, in accordance with the present invention.
Figure 30:
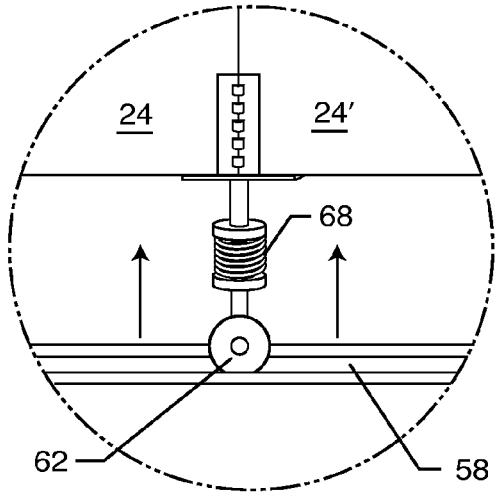
FIG. 30 is an enlarged perspective view similar to FIG. 29, but illustrating the compression of a spring in the wheel assembly due to travel along a slope of the garage floor.
Figure 31:
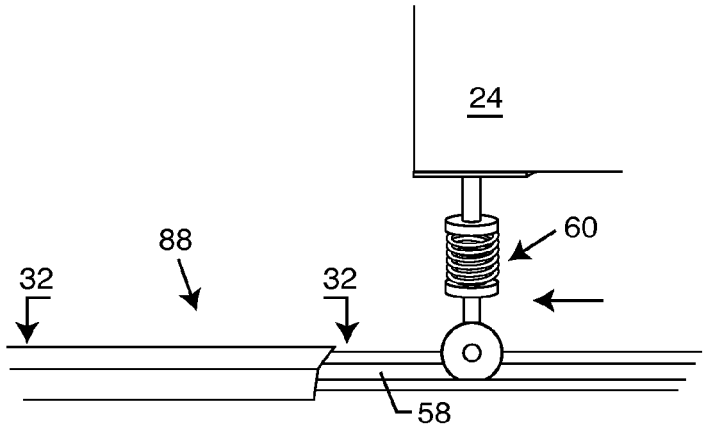
FIG. 31 is a front elevational view illustrating a leading or outer wheel approaching a cover assembly, used in accordance with the present invention.

With reference now to FIGS. 29 and 30, similar movement is illustrated, but with respect to the lower wheel assemblies. In FIG. 29, we can see that the wheel 62 of the lower wheel assembly 60 is operably engaged with the lower track 58. The biasing spring member 68 is in a relatively relaxed, non-compressed, state subject to at least a portion of the weight of the door as the garage door 14 is positioned towards a lower end of the garage floor. However, as illustrated in FIG. 30, as the garage door 14 is moved within the garage, and the garage floor incline comes into play, the spring 68 compresses, effectively creating vertical movement between the wheel 62 and the garage door panels 24 and 24'. That is, comparing FIGS. 29 and 30, the distance between the wheel 62 of the wheel assembly 60 and the lower edge of the garage door panel 24 and 24' decrease as the spring 68 is compressed, such as when traveling inwardly when the garage floor slopes upwardly, or when experiencing other irregularities in the garage floor surface. As discussed above, the garage door 14 may incorporate such biasing means within the wheel assemblies 60 in only the lower wheel assemblies, only the upper wheel assemblies, or in both the upper and lower wheel assemblies. What is important is that the wheel assemblies 60 permit the change in vertical distance, or vertical movement, between the wheel 62 and the garage door panels 24 and 24' so as to accommodate for irregular garage floor surfaces and inclines.

With reference again to FIG. 18, as described above, it has been found that the positioning of the wheels or rollers 62 is also very important in the smooth operation of the horizontally opening and closing garage door 14. When presenting a horizontally opening and closing garage door having a plurality of panels 24 which move along one or more tracks extending from the opening of the garage door to along a side wall of the garage, it is critical that the wheels 62 be placed properly. If not, it has been found that the wheels 62 tend to bind, such as when experiencing the bend 74 and 76 in the upper and lower tracks 56 and 58, respectively. For example, if the wheels 62 extend from approximately a midpoint of each panel 24, such binding and problematic movement from the tracks 56 and 58 at the opening of the garage to the side wall of the garage has been experienced. It has been found that moving the wheels 62 to the edges of the panels 24 provides smooth movement without binding.

Thus, in accordance with the present invention, a leading set of wheel assemblies 60 (illustrated as the left most upper and lower wheel assemblies 60 in FIG. 18) and a trailing set of wheel assemblies 60 (shown in FIG. 18 as the far right upper and lower wheel assemblies 60) should be disposed as close to the leading and trailing edges 78 and 80 of the garage door panels 24 as possible. These are collectively referred to as the outer wheel assemblies. The remaining wheel assemblies between the leading edge 78 of the first garage door panel 24 and the trailing edge 80 of the last garage door panel 24 are referred to herein as inner wheel assemblies. As can be seen in FIG. 18, the inner wheel assemblies are disposed immediately above or below a gap 82 between edges of adjacent panels 24 and 24'.

With reference again to FIG. 25, it can be seen that the support member, typically in the form of a generally planar plate, extends across the gap 82 formed between the adjacent edges of adjacent garage door panels 24 and 24'. The support plate member 72 is pivotally connected, such as by pin 84 to a garage door panel, in this case 24'. A support member plate 72 extends over a portion of the adjoining garage door panel 24. However, the support member plate 72 is not attached to the adjoining garage door panel 24. The adjoining garage door panels 24 and 24' are pivotally attached to one another, such as by pins 86.

Figure 21:
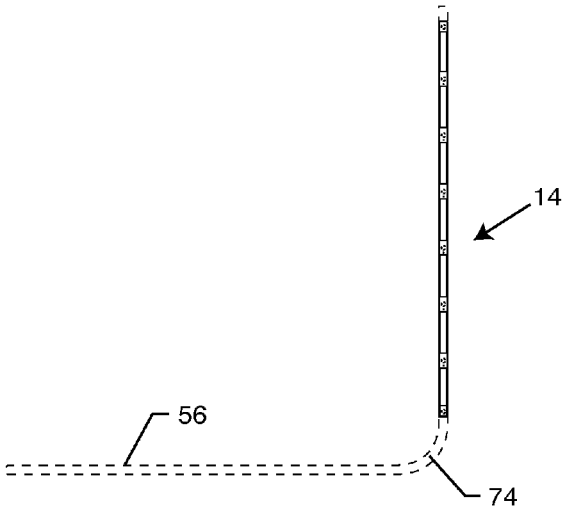
FIG. 21 is a top view illustrating the garage door apparatus of the present invention in a closed state.
Figure 22:
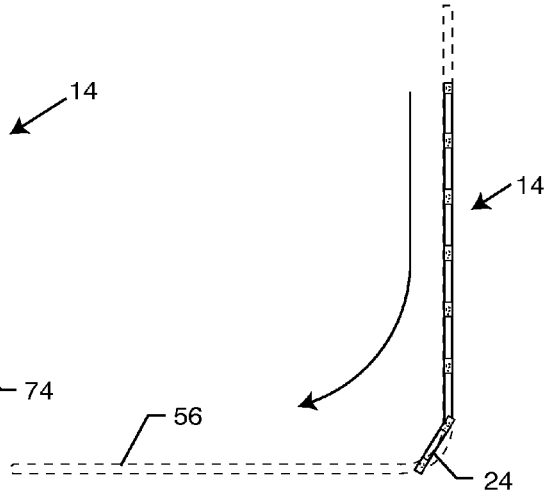
FIG. 22 is a top view of the garage door apparatus, partially opened.
Figure 23:
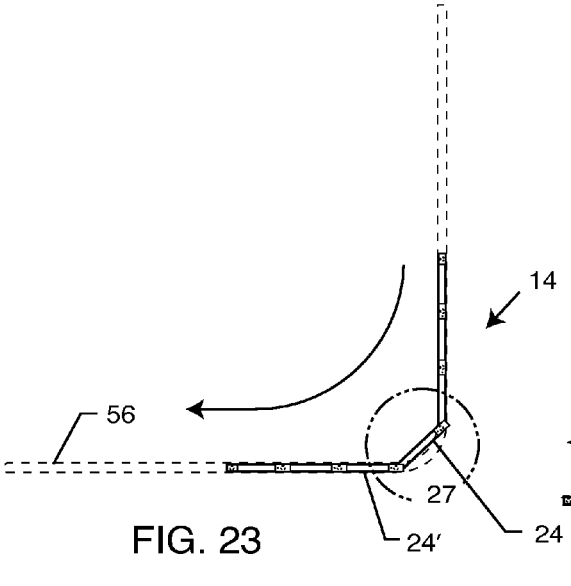
FIG. 23 is a top view similar to FIG. 22, but illustrating the garage door more fully opened.
Figure 24:
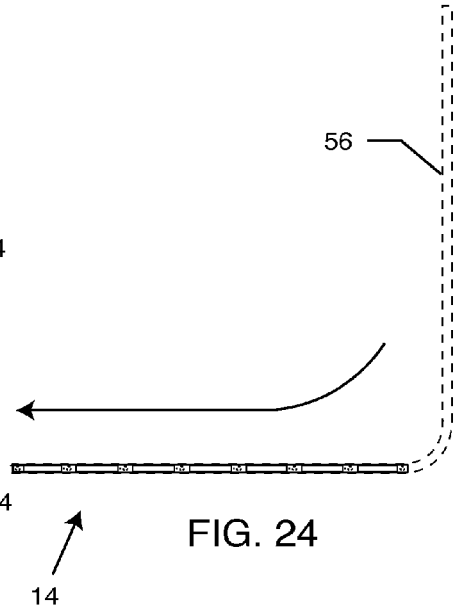
FIG. 24 is a top view similar to FIGS. 21-23, illustrating the garage door in an opened position.
Figure 27:
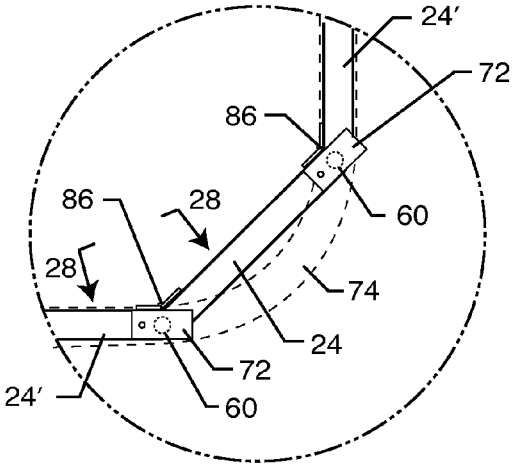
FIG. 27 is an enlarged view of area "27" of FIG. 23, illustrating the door panels passing through a bend of the upper track.
Figure 28:
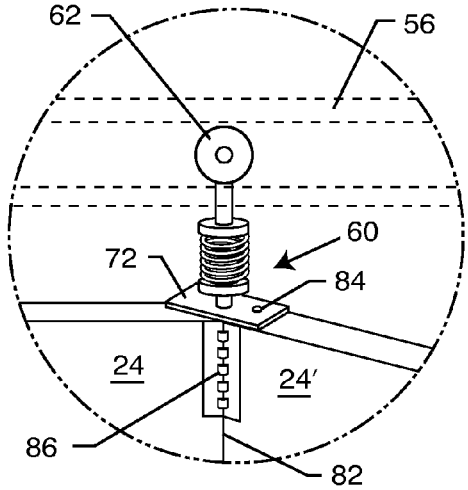
FIG. 28 is an enlarged perspective view taken generally along line 28-28 of FIG. 27.

With reference now to FIGS. 19-24, it can been seen that the lower wheel assemblies 60 are operably engaged with the lower track 58. The upper wheels 62 of the upper wheel assemblies are similarly positioned within track 56. As shown in FIGS. 21-23, as the garage door 14 is moved along the tracks, in this case over track 56, the individual garage door panels 24 pivot with respect to one another so as to traverse bend 74. More particularly, as illustrated in FIGS. 27 and 28, hinges 86 permit the pivoting movement between adjoining door panels 24 and 24'. The support plate members 72 also pivot during such movement, as illustrated in FIG. 28. More particularly, due to the fact that the support member plate 72 is only pivotally attached to one of the adjoining garage door panels 24', the support member plate 72 is able to pivot over and away from the adjoining garage door panel 24 while moving through bend 74 of the track 56. However, wheel 62 remains disposed above the gap 82 between the adjoining door panels 24 and 24', so as not to bind within the track 56. This arrangement and movement occurs with all of the inner wheel assemblies, whether they be upper or lower wheel assemblies as each must pass through a bend 74 or 76 of the track 56 or 58. It will be appreciated that if the wheel 62 were not positioned above the gap 82 between the adjacent door panels 24 and 24', the wheel 62 would experience torsional forces as the panel 24 or 24' were pivoted and rotated through the bend 74 or 76 of the upper or lower track 56 or 58.

With reference now to FIGS. 31-34, with the incorporation of a lower track, certain potential problems present themselves. For example, the lower track may serve as an obstacle and potentially trip someone as they traverse it, such as a woman wearing high heels, wherein the heel can become lodged within the lower track 58. This is the case even if the lower track 58 is formed or built into the floor of the garage. Moreover, the lower track 58 may have debris, such as leaves, pebbles, etc. which find their way into the lower track 58 and prevent smooth operation of the garage door apparatus. Such concerns are particularly relevant to the portion of the lower track 58 disposed immediately adjacent to the opening of the garage.

Figure 33:
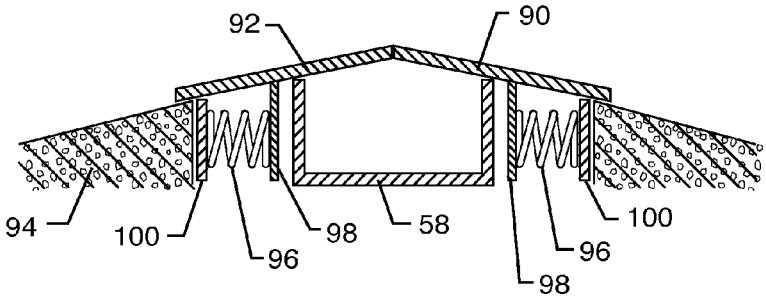
FIG. 33 is a cross-sectional view taken generally along line 33-33 of FIG. 32, illustrating biased cover plate members in a closed position, in accordance with the present invention.
Figure 34:
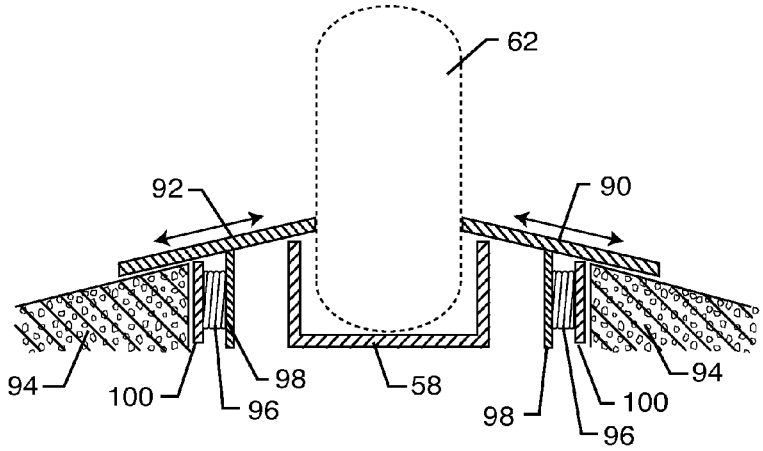
FIG. 34 is a cross-sectional view similar to FIG. 33, illustrating a leading wheel of the garage door apparatus pushing apart the cover plate members and traveling through the lower track, in accordance with the present invention.

In order to accommodate for this, the present invention incorporates a cover assembly 88 which is adapted to cover at least a portion of the lower track 58 when the garage door is open. With reference to FIGS. 31-34, the cover assembly 88 is shown. Although the cover assembly 88 is shown to be relatively small, it will be appreciated that typically the cover assembly 88 extends substantially across at least the portion of the lower track 58 traversing the opening of the garage. With particular reference to FIG. 33, the cover assembly is generally comprised of first and second cover members 90 and 92, typically in the form of metal sheets or plates, which cooperatively cover the lower track 58. As illustrated in FIGS. 33 and 34, the lower track 58 is embedded within the garage floor 94. However, it will be appreciated that the track 58 may also be attached to an upper surface of the floor 94. Each cover member or plate 90 and 92 is biased towards the other and over the lower track 58. Such biasing may be accomplished by means of a spring 96 which serves to bias each cover member 90 or 92 over the opening of the track 58. In this case, the spring 96 is a compression spring which serves to push upon an extension 98 of each cover member 90 and 92, so as to push the cover members 90 and 92 towards one another. The springs are positioned between either the garage floor 94, or a base or stop member 100. Of course, it will also be appreciated that the spring 96 could comprise an extension spring, wherein the spring 96 serves to pull the cover members 90 and 92 towards one another with essentially a reverse arrangement being proposed.

Figure 32:
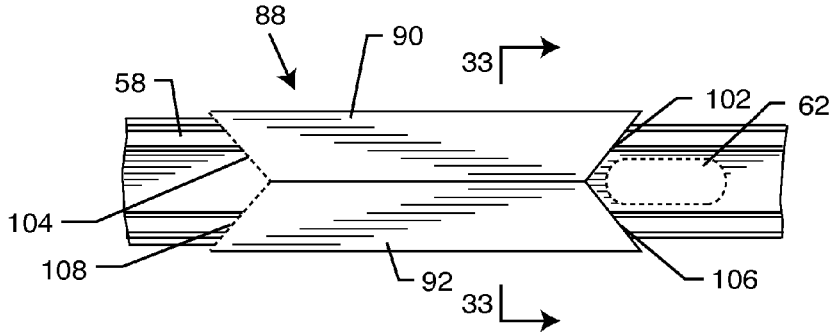
FIG. 32 is a top plan view taken generally along line 32-32 of FIG. 1, illustrating cover plate members of the cover assembly in a closed position.

With reference now to FIGS. 32 and 34, in a particularly preferred embodiment, the ends 102 and 104 of the first cover member 90 are of an angular configuration, and the ends 106 and 108 of the other cover plate member 92 are also of an angled configuration so as to form a generally U or V shape. This permits the leading wheel 62 to force the plate members 90 and 92 away from one another, as illustrated in FIG. 34, as the garage door is closed. It will be appreciated that when the garage door is opened, and the wheels 62 are moved out of the track 58, the cover members 92 and 94 are biased back into place above the lower track 58 so as to cover it.

Thus, it will become apparent to those skilled in the art that the horizontally opening and closing garage door of the present invention provides many benefits as compared to vertically opening and closing garage doors. The door can be opened partially and one can enter or exit with no effort. A walk-in door can be incorporated into the garage door 14 and 14'. When partially opened, there is only a limited view of the garage, thus not displaying the entire garage or the contents thereof. The doors need only be opened partially to allow a vehicle to enter the garage 12. The garage 12 is safer since the door 14 does not fall to close or pull up to open. The garage doors 14 or 14' can be made of any type of material, as weight is not as great of a consideration. Additionally, the ceiling of the garage remains free of any parts from doors such as motors or mechanisms, and all working parts may be hidden so beauty is added to the outside of the garage as well as the inside, adding to the beauty of the home.

Although several embodiments have been described in detail for purposes of illustration, various modifications may be made without departing from the scope and spirit of the invention. Accordingly, the invention is not to be limited, except as by the appended claims.

What is claimed is:

1. A garage door apparatus for a garage having a front wall defining a garage vehicle entrance, at least one side wall, a ceiling, and a floor, the apparatus comprising:

an upper track extending from the front wall to the side wall within the garage;

a lower track attached to or formed in the floor of the garage and extending generally parallel to the upper track from the front wall to the side wall within the garage;

a garage door comprised of a plurality of vertically oriented panels pivotally interconnected with one another along side edges thereof, and disposed between the upper and lower tracks so as to be movable along a length thereof;

a plurality of upper wheel assemblies extending from upper edges of the garage door panels and operably engaged with the upper track;

a plurality of lower wheel assemblies extending from lower edges of the garage door panels and operably engaged with the lower track; and means for moving the garage door along the track from a generally closed position in the garage vehicle entrance to a generally open position away from the garage vehicle entrance and disposed adjacent to the side wall of the garage;

wherein the upper and lower wheel assemblies include outer wheel assemblies disposed adjacent to a leading edge and a trailing edge, respectively, of the garage door, and inner wheel assemblies, the upper and lower wheel assemblies disposed above or below, respectively, a gap between adjacent side edges of the vertical panels of the garage door;

wherein the inner wheel assemblies each include a support pivotally attached to a top edge of a first vertical panel and extending over a portion of a second adjacent vertical panel; and wherein at least a plurality of the upper or lower wheel assemblies each include a resilient member disposed between the wheel and the garage door panel to permit limited vertical movement between the wheel and the garage door panel while the wheel remains engaged with the track.

2. The apparatus of claim 1, wherein the moving means comprises a chain or screw connected to the garage door and a motor for selectively moving the chain or screw.

3. The apparatus of claim 1, including a second garage door connected to a second track extending from the front wall to an opposite side wall within the garage and means for moving the second garage door along the second track from a generally closed position in the garage vehicle entrance to a generally open position away from the garage vehicle entrance and disposed adjacent to the opposite side wall of the garage.

4. The apparatus of claim 1, wherein the garage door includes a walk-in door formed in a single panel thereof and adapted to permit access to the garage when the garage door is in its closed position.

5. The apparatus of claim 1, including a catch formed in the front wall adjacent to the garage opening adapted to releasably receive an extension of a trailing edge of the garage door as it is closed.

6. The apparatus of claim 1, including a cover assembly adapted to cover at least a portion of the lower track not supporting panels when the garage door is open.

7. The apparatus of claim 6, wherein the cover comprises first and second cover members biased towards one another so as to cooperatively cover at least a portion of the lower track.

8. The apparatus of claim 1, wherein the resilient member comprises a spring.

* * * * *